US008925340B2

(12) United States Patent
Chung et al.

(10) Patent No.: US 8,925,340 B2
(45) Date of Patent: Jan. 6, 2015

(54) ICE BANK OF REFRIGERATOR

(75) Inventors: Sung Hoon Chung, Seoul (KR); Eui Yeop Chung, Seoul (KR); Nam Gi Lee, Seoul (KR); Wook Yong Lee, Incheon-si (KR)

(73) Assignee: LG Electronics Inc., Seoul (KR)

( * ) Notice: Subject to any disclaimer, the term of this patent is extended or adjusted under 35 U.S.C. 154(b) by 459 days.

(21) Appl. No.: 12/842,847

(22) Filed: Jul. 23, 2010

(65) Prior Publication Data

US 2010/0281906 A1 Nov. 11, 2010

Related U.S. Application Data

(63) Continuation of application No. 12/620,498, filed on Nov. 17, 2009, now Pat. No. 7,818,975, which is a continuation of application No. 11/385,733, filed on Mar. 22, 2006, now Pat. No. 7,631,513.

(30) Foreign Application Priority Data

Mar. 25, 2005 (KR) ..... 24804/2005
Apr. 20, 2005 (KR) ..... 32881/2005

(51) Int. Cl.

| | |
|---|---|
| ***F25C 5/02*** | (2006.01) |
| ***F25C 5/18*** | (2006.01) |
| ***F25D 25/00*** | (2006.01) |
| ***F25C 5/04*** | (2006.01) |
| ***F25C 5/00*** | (2006.01) |

(52) U.S. Cl.

CPC ..... *F25C 5/046* (2013.01); *F25C 2500/08* (2013.01); *F25C 2500/02* (2013.01); *F25C 5/005* (2013.01)

USPC ..... 62/320; 62/344; 62/377

(58) Field of Classification Search

USPC ..... 62/344, 377, 320; 241/DIG. 17

See application file for complete search history.

(56) References Cited

U.S. PATENT DOCUMENTS

| | | | | | |
|---|---|---|---|---|---|
| 3,602,441 | A | * | 8/1971 | Alvarez | 241/101.2 |
| 3,824,805 | A | * | 7/1974 | Prada | 62/320 |
| 3,889,888 | A | | 6/1975 | Prada | |
| 4,176,527 | A | * | 12/1979 | Linstromberg et al. | 62/320 |
| 4,942,979 | A | | 7/1990 | Linstromberg et al. | |
| 4,972,999 | A | | 11/1990 | Grace | |
| 5,050,777 | A | | 9/1991 | Buchser | |
| 5,056,688 | A | | 10/1991 | Goetz et al. | |
| 5,273,219 | A | | 12/1993 | Beach, Jr. et al. | |
| 6,148,624 | A | * | 11/2000 | Bishop et al. | 62/137 |
| 6,425,259 | B2 | * | 7/2002 | Nelson et al. | 62/344 |
| 6,442,954 | B1 | * | 9/2002 | Shapiro et al. | 62/137 |
| 6,904,765 | B2 | | 6/2005 | Lee et al. | |

(Continued)

FOREIGN PATENT DOCUMENTS

| | | | |
|---|---|---|---|
| CN | 1573267 | A | 2/2005 |
| JP | 51-21165 | U | 2/1976 |

(Continued)

*Primary Examiner* — Cheryl J Tyler
*Assistant Examiner* — Elizabeth Martin
(74) *Attorney, Agent, or Firm* — Birch, Stewart, Kolasch & Birch, LLP

(57) ABSTRACT

An ice bank of a refrigerator is provided. The ice bank includes an ice accommodation chamber storing ice pieces made by an ice maker, and an ice pressing unit circulating the ice pieces by pressing the ice pieces for preventing sticking of the ice pieces in the ice accommodation chamber.

7 Claims, 12 Drawing Sheets

(56) References Cited

U.S. PATENT DOCUMENTS

| | | | | |
|---|---|---|---|---|
| 6,964,177 | B2 | 11/2005 | Lee et al. | |
| 7,040,111 | B2 | 5/2006 | Lee et al. | |
| 7,051,541 | B2 | 5/2006 | Chung et al. | |
| 7,222,498 | B2 | 5/2007 | Lee et al. | |
| 7,481,387 | B2 | 1/2009 | Lee et al. | |
| 2004/0163405 | A1 * | 8/2004 | Jung | 62/344 |
| 2004/0237563 | A1 * | 12/2004 | Lee et al. | 62/340 |
| 2004/0237565 | A1 * | 12/2004 | Lee et al. | 62/344 |
| 2004/0237569 | A1 | 12/2004 | Lee et al. | |
| 2005/0044874 | A1 * | 3/2005 | Lee et al. | 62/344 |
| 2005/0072167 | A1 * | 4/2005 | Oh | 62/137 |

FOREIGN PATENT DOCUMENTS

| | | |
|---|---|---|
| KR | 1020020030709 | * 12/2003 |
| KR | 1020030092871 | * 12/2003 |
| KR | 10-2004-0074856 | 8/2004 |
| KR | 10-2005-0021066 | 3/2005 |
| KR | 1020030059154 | * 3/2005 |

* cited by examiner

ICE BANK OF REFRIGERATOR

This application is a continuation of application Ser. No. 12/620,498, filed on Nov. 17, 2009 now U.S. Pat. No. 7,818,975, which is a continuation of application Ser. No. 11/385,733, now U.S. Pat. No. 7,631,513, filed on Mar. 22, 2006, the entire contents of which are hereby incorporated by reference and for which priority is claimed under 35 U.S.C. §120.

BACKGROUND OF THE INVENTION

1. Field of the Invention

The present invention relates to a refrigerator, and more particularly, to an ice bank of a refrigerator.

2. Description of the Related Art

An ice bank of a refrigerator stores ice made by an ice maker and supplies the ice to a user after breaking the ice to a proper size.

The ice maker is attached to a refrigerator for making ice to a desired size and supplying the ice to a user. Recently, instead of installing the ice maker as an optional or additional part, more manufactures install the ice maker to the refrigerator as a fixed part in order to satisfy customer's demand. The ice bank (or an ice bin) stores ice made by the ice maker to supply the ice to a user. Therefore, even when a user requires a large amount of ice, the ice bank can supply the ice immediately.

Generally, the ice bank includes a storing chamber for storing a large amount of ice, an ice crusher for crushing the ice, and a carrier for carrying the ice from the storing chamber to the ice crusher.

Meanwhile, when a large amount of ice is stored in the storing chamber, ice pieces may mix with each other and stick to each other. In this case, the ice pieces cannot be carried by the carrier. Therefore, a user has to take out the ice bank and manually break the lumped ice pieces to use the ice bank again. Further, it can be detected that the ice bank is fully filled with ice although the ice bank is not fully filled with ice. Therefore, the ice maker may abnormally operate.

Particularly, if the ice maker and the ice bank are installed in a refrigerator door as fixed parts, the size of the ice bank is restricted, thereby increasing the possibility of sticking of the ice since ice pieces easily make contact with each other. That is, the possibility of sticking of the ice in the ice bank increases when the ice maker and the ice bank are installed in the refrigerator door as fixed parts.

Furthermore, the ice bank of the related art includes a bar to fix blades to its lower portion. The bar connects the respective blades. Therefore, when ice is discharged from the ice bank through a lower portion of the ice bank, the bar disturbs the discharging of the ice. In addition, the possibility of sticking of the ice increases due to the bar when the ice is discharged. Thus, there is a need for an ice bank that has an improved structure for obviating those problems.

SUMMARY OF THE INVENTION

Accordingly, the present invention is directed to an ice bank of a refrigerator that substantially obviates one or more problems due to limitations and disadvantages of the related art.

An object of the present invention is to provide an ice bank of a refrigerator, which has an improved structure for preventing ice pieces stored in the ice bank from sticking to each other.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an ice bank of a refrigerator for storing ice pieces made by an ice maker, the ice bank including: an ice accommodation chamber storing the ice pieces made by the ice maker; and an ice pressing-unit circulating the ice pieces by pressing the ice pieces for preventing sticking of the ice pieces in the ice accommodation chamber.

In another aspect of the present invention, there is provided an ice bank of a refrigerator for storing ice pieces made by an ice maker, the ice bank including: an ice accommodation chamber storing the ice pieces made by the ice maker and including an ice receiving part in a lower portion; a carrier carrying the ice pieces stored in the ice accommodation chamber; and a separator pressing-the ice pieces for preventing sticking of the ice pieces in the ice accommodation chamber.

In a further another aspect of the present invention, there is provided an ice bank of a refrigerator for storing ice pieces made by an ice maker, the ice bank including: a casing; an ice accommodation chamber formed in the casing and storing the ice pieces made by the ice maker; and a stationary blade directly connected to the casing.

In a still further another aspect of the present invention, there is provided an ice bank of a refrigerator for storing ice pieces made by an ice maker, the ice bank including: a casing as an enclosing structure; an ice accommodation chamber formed in the casing and storing the ice pieces made by the ice maker; a shutter including a guide protrusion for guiding the ice pieces stored in the ice accommodation chamber; and a rotary blade including an ice removing protrusion for separating ice pieces stuck to the shutter around the guide protrusion.

According to the ice bank of the present invention, the ice stored in the ice bank can be prevented from sticking to each other, thereby increasing the operating reliability of the ice bank.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
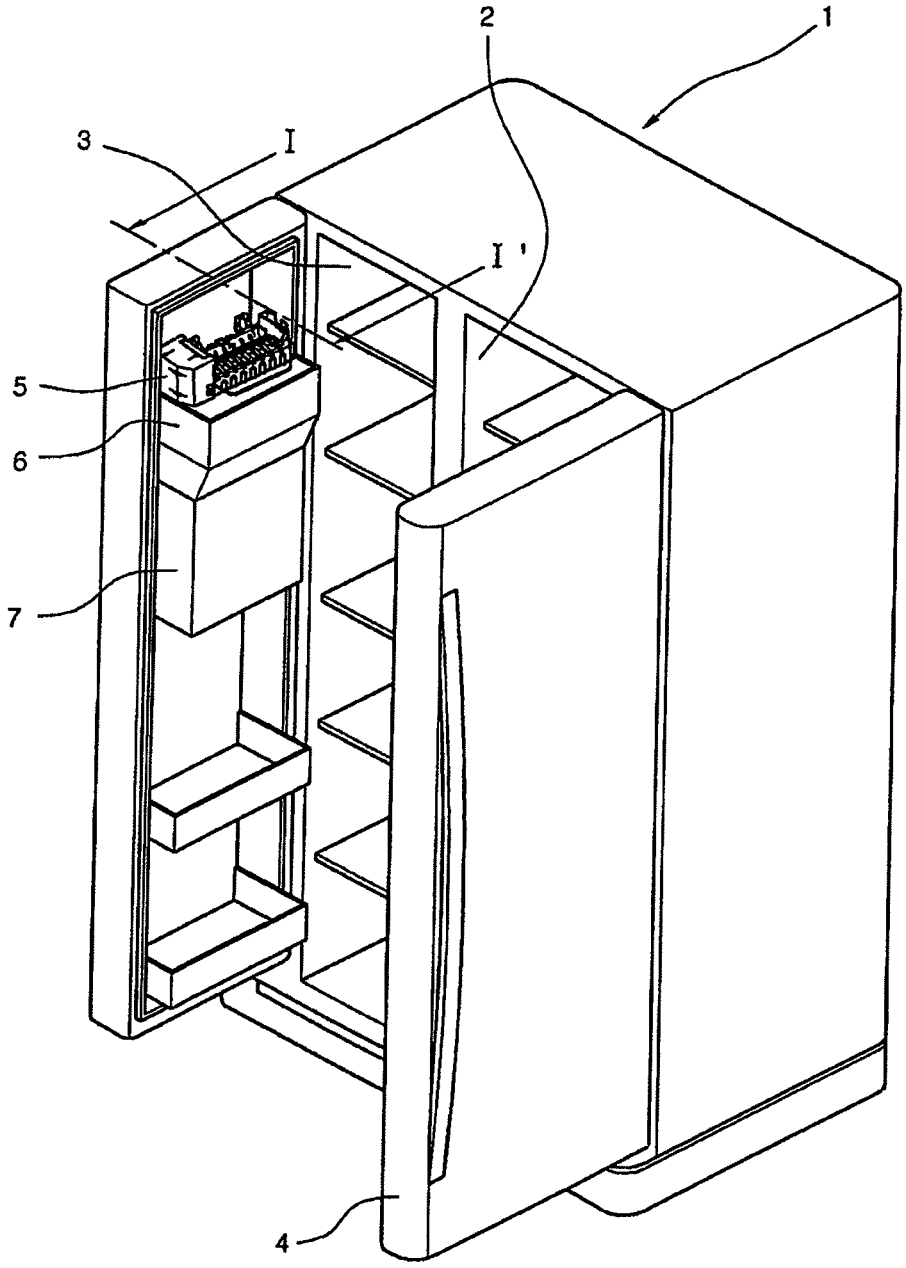
FIG. 1 is a perspective view of a refrigerator having an ice bank according to a first embodiment of the present invention.

FIG. 1 is a perspective view of a refrigerator having an ice bank according to a first embodiment of the present invention.

Referring to FIG. 1, a refrigerator 1 stores food at a low temperature through a refrigeration cycle using a compressor, a condenser, an expansion valve, and an evaporator.

The refrigerator 1 includes a refrigerator compartment 2 for storing food at a low temperature above zero (above the freezing point) and a freezer compartment 3 for storing food and ice at a low temperature below zero. The refrigerator 1 further includes an ice maker 5 disposed in the freezer compartment 3 for making ice, an ice bank 6 for storing the ice made by the ice maker 5, and an ice dispenser 7 for supplying the ice from the ice bank 6 to a user.

The refrigerator further includes an ice crusher 37 (refer to FIG. 3) for breaking ice to a proper size and a carrier 34 (refer to FIG. 3) for carrying the ice to the ice crusher 37.

An operation of the ice maker 5 will now be simply described.

A proper amount of water is supplied to the ice maker 5, and cooling air is supplied to the ice maker 5 to freeze the water. When ice is formed in the ice maker 5 by the supplied cooling air, the ice maker 5 operates to separate the ice and drop the separated ice to the ice bank 6. A user can take a desired amount of ice from the ice bank 6 using the ice dispenser 7.

Figure 2:
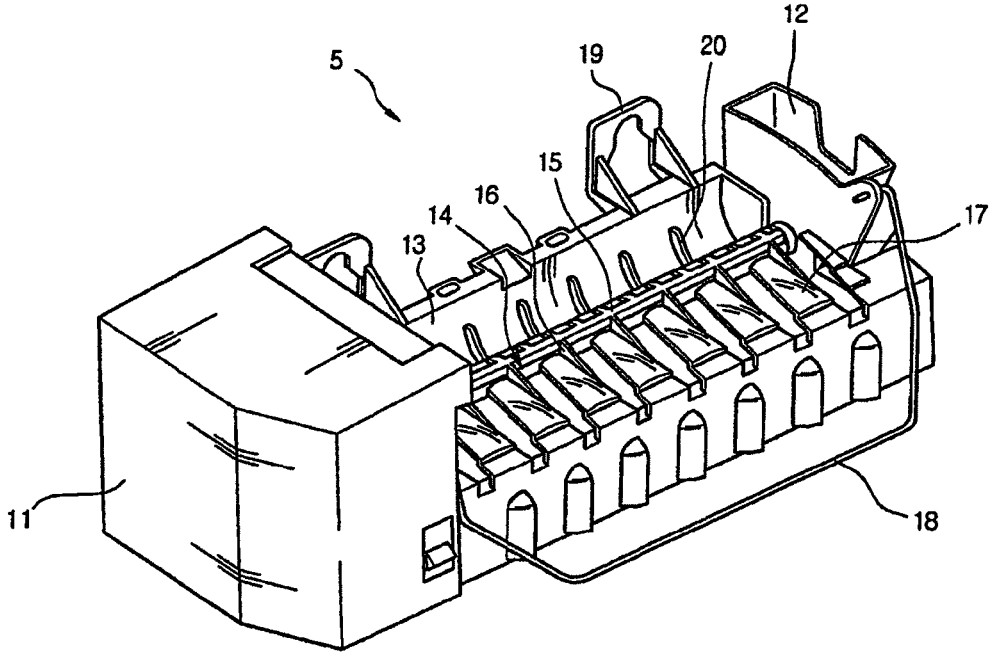
FIG. 2 is a perspective view of an ice maker depicted in FIG. 1.

FIG. 2 is a perspective view of the ice maker 5 depicted in FIG. 1.

Referring to FIG. 2, the ice maker 5 makes ice using cooling air supplied from the refrigerator 1. The ice maker 5 includes a water feeder 12 for receiving wafer from an outside, an ice making room 13 in which water freezes, an ejector 14 for separating ice from the ice making room 13, and a control box 11 in which many parts are installed for rotating the ejector 14. The ice maker 5 further includes mounting portions 19 on a back area of the ice making room 13 for mounting the ice maker 5 on an inside of the refrigerator 1, and an ice-overflow sensing lever 18 for detecting whether the ice bank 6 is fully filled with ice or not.

In detail, the ejector 15 includes a rotary shaft 15 extended from the control box 11 and extension arms 16 extended from the shaft 15 for ejecting ice from the ice making room 13 when the shaft 15 rotates. Barrier ribs 20 are formed on an inner surface of the ice making room 13 to divide the ice making room 13 into many sections corresponding to the size of ice pieces to be made in the ice making room 13. A separator 17 is installed on a top portion of the ice making room 13 for guiding the ice drawn up by the ejector 14 down to the ice bank 6. A heater (not shown) is installed under the ice making room 13 for heating the ice to separate the ice from the inner surface of the ice making room 13.

An operation of the ice maker 5 will now be described according to the above-described structure of the ice maker 5.

Water is supplied to the water feeder 12 through a water supplying line. The water flows from the water feeder 12 into each section formed in the ice making room 13 by the barrier ribs 20. The water freezes in the sections of the ice making room 13 by sub-zero cooling air supplied to the ice making room 13.

After the water completely freezes, the ejector 14 is operated by a driving mechanism of the control box 11. In detail, the shaft 15 is rotated to push up the ice along the inner surface of the ice making room 13 using the extension arms 16. Before the ejector 14 is operated, the heater (not shown) installed under the ice making room 13 applies heat to the ice making room 13 to separate the ice from the inner surface of the ice making room 13.

The pushed-up ice is guided by the separator 17 down to the ice bank 6 and stored in the ice bank 6.

This process is repeated until the ice bank 6 is fully filled with the ice. The ice maker 5 stops when the ice-overflow sensing lever 18 detects the fully-filled state of the ice bank 6.

Figure 3:
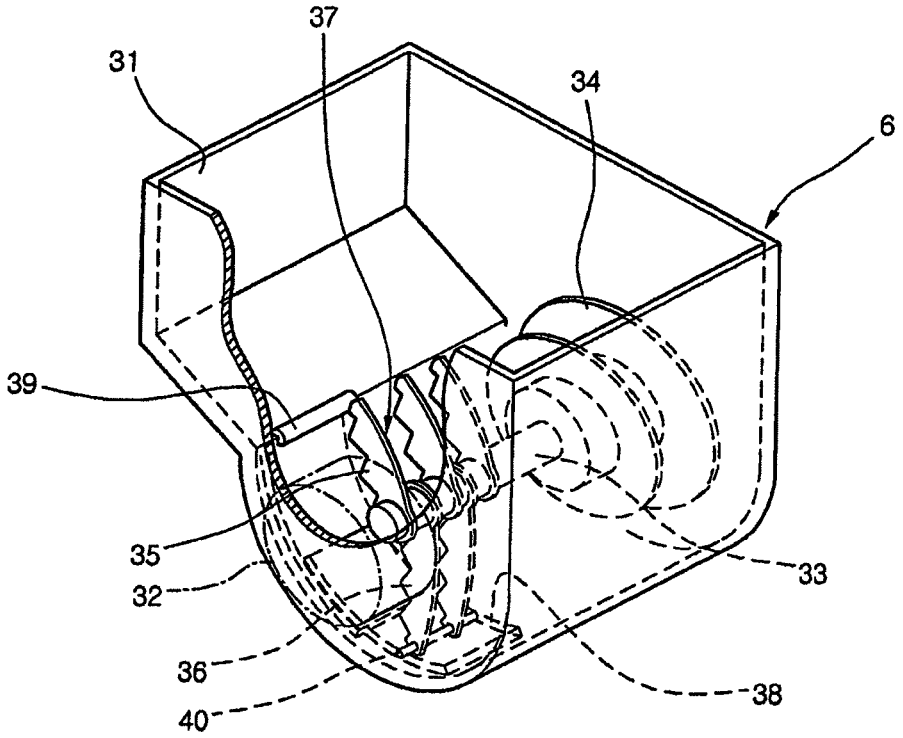
FIG. 3 is a perspective view of the ice bank depicted in FIG. 1.

FIG. 3 is a perspective view of the ice bank depicted in FIG. 1.

Referring to FIG. 3, the ice bank 6 includes a casing 31 forming an ice storing space, the ice crusher 37 disposed in a lower portion of the casing 31, and the carrier 34 carrying ice to the ice crusher 37. The ice bank 6 further includes an ice outlet 38 through which crushed ice drops down and a shutter 39 changing the size of the ice outlet 38 for adjusting the size of the falling ice through the ice outlet 38. A spiral auger may be used for the carrier 34.

The ice crusher 37 includes stationary blades 36 fixed to the casing 31, rotary blades 35 rotatable with respect to the stationary blade 36, a shaft 33 coupled with the rotary blades 35 for transmitting a driving force to the rotary blades 35, and a motor 32 connected to an end of the shaft 33.

In detail, the motor 32 is placed on an outer surface of the casing 31. The shaft 33 is connected to the motor 32 to transmit a driving force from the motor 32 to the rotary blades 35. One ends of the stationary blades 36 are fixed to a stationary blade fixing part 40 formed at a predetermined position on the inner surface of the casing 31. The shaft 33 is supportedly inserted into predetermined portions of the stationary blades 36. Therefore, the stationary blades 36 can be kept stationary when the shaft 33 rotates. For this, the shaft 33 and the stationary blades 36 are not fixed to each other.

In operation of the ice crusher 37, ice is guided between the stationary blades 36 and the rotary blades 35 by rotation of the rotary blades 35 and is crushed by a force exerted by the rotation of the rotary blades 35. The crushed ice falls down through the ice outlet 38 formed under the stationary blades 36. The dispenser 7 is disposed under the ice outlet 38 for supplying the fallen ice to a user.

An operation of the ice bank 6 will now be simply described. Ice made by the ice maker 5 falls down to the ice bank 6. The ice is crushed in the ice bank 6 to a proper size and supplied to a user by a desired quantity. For this, the carrier 34 is operated by a driving force transmitted from the motor 32 through the shaft 33. The ice is carried by the operation of the carrier 34 to the ice crusher 37. Then, the ice is crushed by the ice crusher 37 and discharged through the ice outlet 38. Here, the ice crusher 37 as well as the carrier 34 is used as an ice carrying part since the ice crusher 37 makes contact with the ice and pushes the ice. In detail, when the rotary blades 35 start rotating, the rotary blades 35 make direct contact with the ice to crush and move the ice.

The size of the ice outlet 38 can be adjusted using the shutter 39, such that ice having a desired size can be discharged through the ice outlet 38. That is, relatively large ice can be discharged by increasing the size of the ice outlet 38 using the shutter 39, and on the contrary, relatively small ice can be discharged by decreasing the size of the ice outlet 38 using the shutter 39.

The ice discharging rate of the ice bank 6 can be increased or decreased by increasing or decreasing the rotation speed of the motor 32. In this way, the amount of ice discharging from the ice bank 6 can be controlled. If the carrier 34 has a small pitch, small ice is carried at a low rate, and if the carrier 34 has a large pitch, large ice is carried at a high rate. Further, the size and quantity of the ice can be controlled by adjusting the size and number of the blades 35 and 36.

Meanwhile, the ice bank 6 of the present invention is characterized in that ice pieces can be prevented from sticking to each other in the casing 31. This characteristic will now be described with reference to FIGS. 4 to 7.

Figure 4:
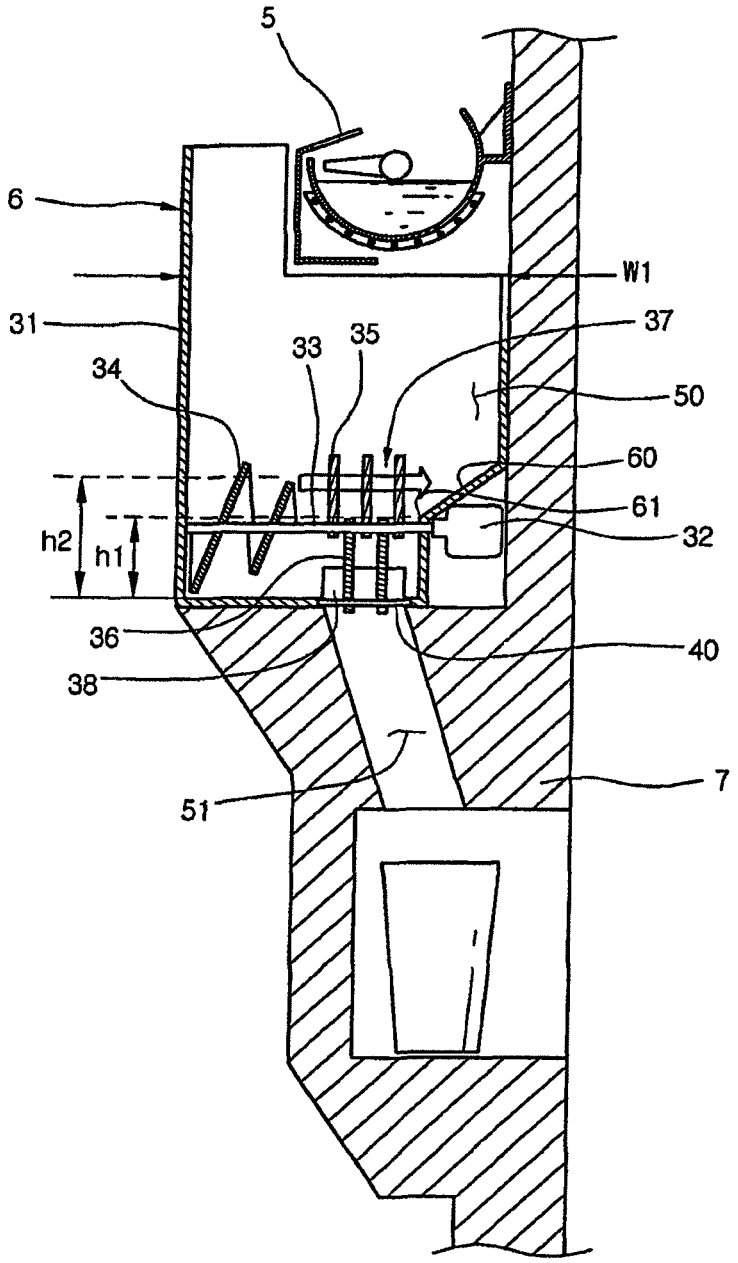
FIG. 4 is a vertical section taken along line I-I' of FIG. 1 to show the ice bank.

FIG. 4 is a vertical section taken along line I-I' of FIG. 1 to show the ice bank.

Referring to FIG. 4, the ice bank 6 includes an ice accommodation chamber 50 for receiving ice made by the ice maker 5 and an ice pressing unit pressing the ice for preventing ice pieces from sticking to each other.

In the current embodiment, the carrier 34 installed in the ice bank 6 may be used as the ice pressing unit. As described above, an auger may be used for the carrier 34.

Further, in the current embodiment, the ice crusher 37 installed in the ice bank 6 may be used as the ice pressing unit. In detail, the ice crusher 37 includes the stationary blades 36 and the rotary blades 35. The stationary blades 36 do not move with respect to the casing 31, and the rotary blades 35 rotate with respect to the stationary blades 36. Ice is circulated in the ice accommodation chamber 50 by the rotation of the rotary blades 35. Therefore, the ice pieces can be prevented from sticking to each other.

Here, both the carrier 34 and the ice crusher 37 may be used as the ice pressing unit, or one of the carrier 34 and the ice crusher 37 may be used as the ice pressing unit.

An ice receiving part 60 is formed on a lower portion of the ice accommodation chamber 50. The ice receiving part 60 forms a lower portion of the ice accommodation chamber 50 and supports ice accommodated in the ice accommodation chamber 50. The ice receiving part 60 is inclined at a predetermined angle, such that the ice can be effectively moved from the ice receiving part 60 to the ice crusher 37 and/or the carrier 34. Therefore, the operating efficiencies of the ice crusher 37 and/or the carrier 34 can be increased.

In the current embodiment, the ice receiving part 60 has a lower end height h1 smaller than a pressing height h2 of the ice pressing unit (the carrier 34 and/or the ice crusher 37). In detail, the ice receiving part 60 includes a surface 61 facing the ice pressing unit, and the height h1 of the facing surface 61 is smaller than the pressing height h2 of the ice pressing unit. Therefore, the pressing force of the ice pressing unit (the carrier 34 and/or the ice crusher 37) can be smoothly exerted on the ice stacked on the ice receiving part 60. Thus, the ice on the ice receiving part 60 can be circulated in the ice accommodation chamber 50 by the pressing forces of the carrier 34 and/or the ice crusher 37, so that sticking of the ice can be prevented.

Figure 5:
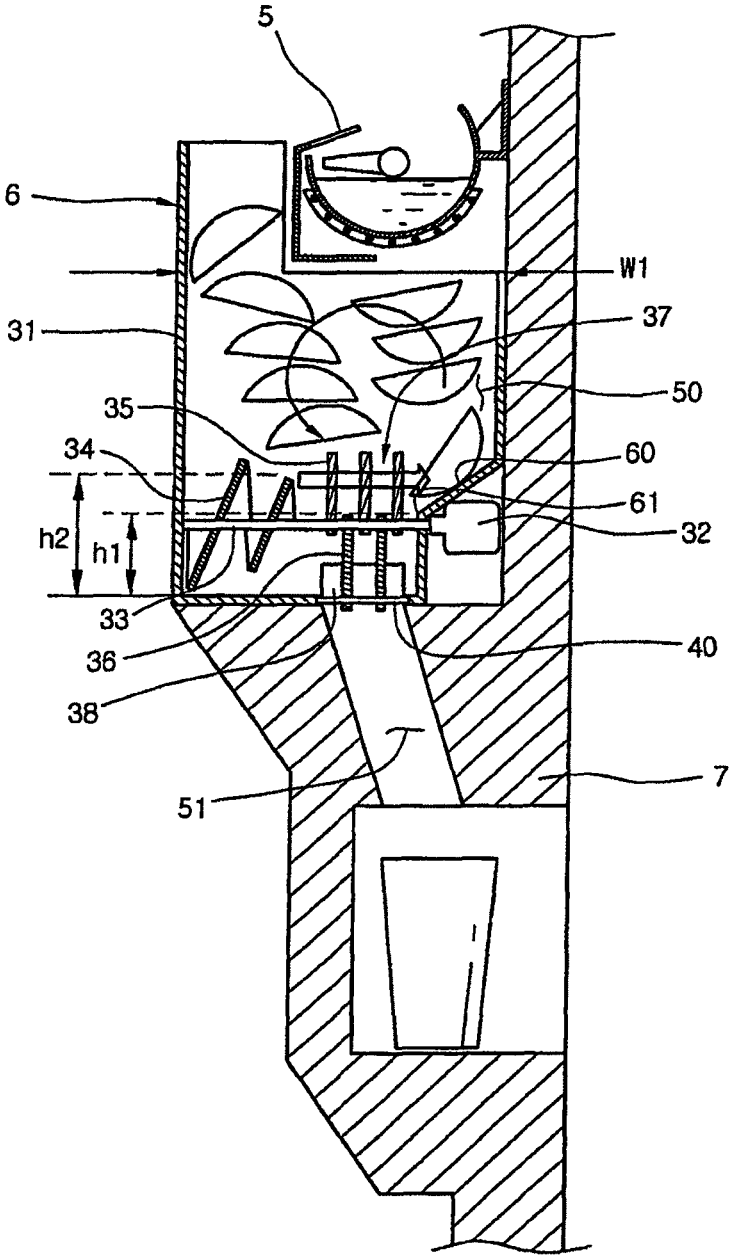
FIG. 5 is the vertical section of FIG. 4 when the ice bank operates.

FIG. 5 is the vertical section of FIG. 4 when the ice bank 6 operates. An operation of the ice bank 6 will now be described with reference to FIG. 5 according to the first embodiment of the present invention.

Ice made by the ice maker 5 is sent to the ice accommodation chamber 50. In the ice accommodation chamber 50, some of the ice from the ice maker 5 is placed on the inclined ice receiving part 60. Then, the ice placed on the ice receiving part 60 slides down to the carrier 34 and/or the ice crusher 37. Therefore, the ice can be carried by the carrier 34 or crushed to a predetermined size by the ice crusher 37.

According to the present invention, the carrier 34 and/or the ice crusher 37 can be used as the ice pressing unit to prevent sticking of the ice. In detail, the carrier 34 and/or the ice crusher 37 presses the ice slid from the inclined surface of the ice receiving part 60. As described above, the height h1 of the surface 61 of the ice receiving part 60 is smaller than the pressing height h2 of the ice pressing unit, such that the ice pressing unit can effectively press the ice pieces placed on the ice receiving part 60.

The ice pieces pressed by the ice pressing unit can be reversely slide along the inclined surface of the ice receiving part 60 and press the neighboring ice pieces. In this way, the pressing force exerted by the ice pressing unit is successively transmitted through the adjoining ice pieces, such that the ice pieces can be continuously moved in a reverse direction. Therefore, the ice pieces can be circulated through the ice accommodation chamber 50 and thus the sticking of the ice pieces can be prevented.

Another embodiment of the present invention will now be described. The same elements or operations as the first embodiment will not be described.

Figure 6:
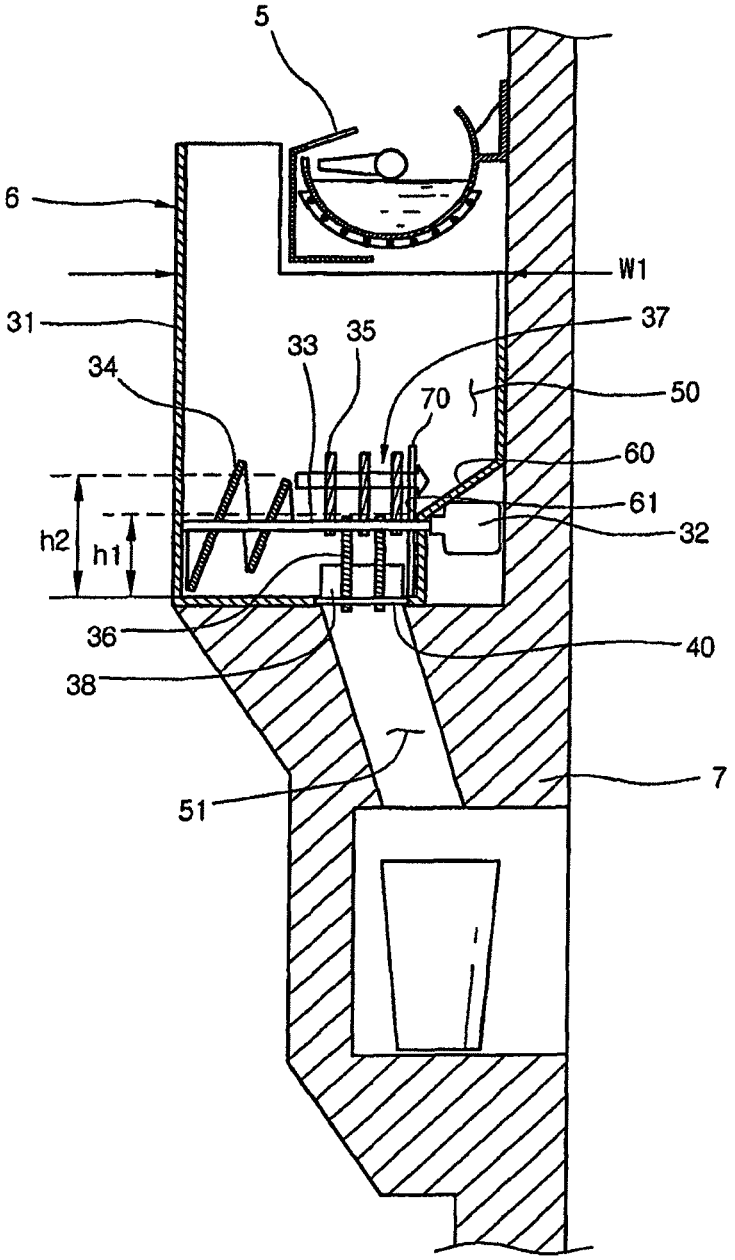
FIG. 6 is a vertical section of an ice bank according to a second embodiment of the present invention.
Figure 7:
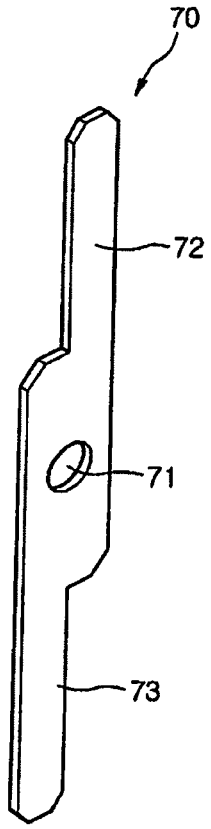
FIG. 7 is a perspective view of a separator depicted in FIG. 6.

FIG. 6 is a vertical section of an ice bank according to a second embodiment of the present invention, and FIG. 7 is a perspective view of a separator depicted in FIG. 6.

Referring to FIGS. 6 and 7, an ice bank 6 receives ice made by an ice maker 5. The ice bank includes an ice accommodation chamber 50 and a carrier 34. The ice accommodation chamber 50 includes an ice receiving part 60 in a lower portion, and the carrier 34 carries ice stored in the ice accommodation chamber 50. The ice bank 6 further includes a separator 70 pressing the ice stored in the ice accommodation chamber 50.

The separator 70 includes a shaft hole 71 for coupling with a shaft, and separator blades 72 and 73 each extending from the shaft hole 71 to a predetermined length. The separator blades 72 and 73 may be symmetric with respect to the shaft hole 71. The separator blades 72 and 73 press ice when the separator 70 rotates.

The separator 70 as it rotates presses ice placed on the ice receiving part 60 to prevent ice pieces from sticking to each other. In detail, when ice pieces made by the ice maker 5 are accommodated in the ice accommodation chamber 50, some of the ice pieces are placed on the ice receiving part 60. The separator 70 applies a pressing force to the ice pieces placed on the ice receiving part 60.

In the present invention, as described above, the height h1 of the surface 61 of the ice receiving part 60 is smaller than the pressing height h2 of the ice pressing unit. Therefore, the ice pieces placed on the ice receiving part 60 effectively receives a pressing force from the separator 70, such that the ice pieces can flow smoothly in a reverse direction. The reverse flow of the ice pieces sequentially advances through adjoining ice pieces, such that the ice pieces can circulate inside the ice accommodation chamber 50, thereby preventing sticking of the ice pieces.

Here, to prevent the ice pieces from sticking to each other, the separator 70 operates together with the ice pressing unit (the carrier 34 and/or the ice crusher 37).

Preferably, the separator 70 rotates about the same shaft 33 as the carrier 34. In this case, the separator 70 can be rotated by a motor 32 rotating the carrier 34 without using an additional driving unit.

Further, it is preferable that the separator 70 be disposed between the ice receiving part 60 and the carrier 34. In this case, since the separator 70 makes direct contact with ice pieces placed on the ice receiving part 60, the separator 70 can press the ice pieces more effectively. For the same reason, preferably, the separator 70 has a pressing height h2 larger than the height h1 of the surface 61 of the ice receiving part 60.

Figure 8:
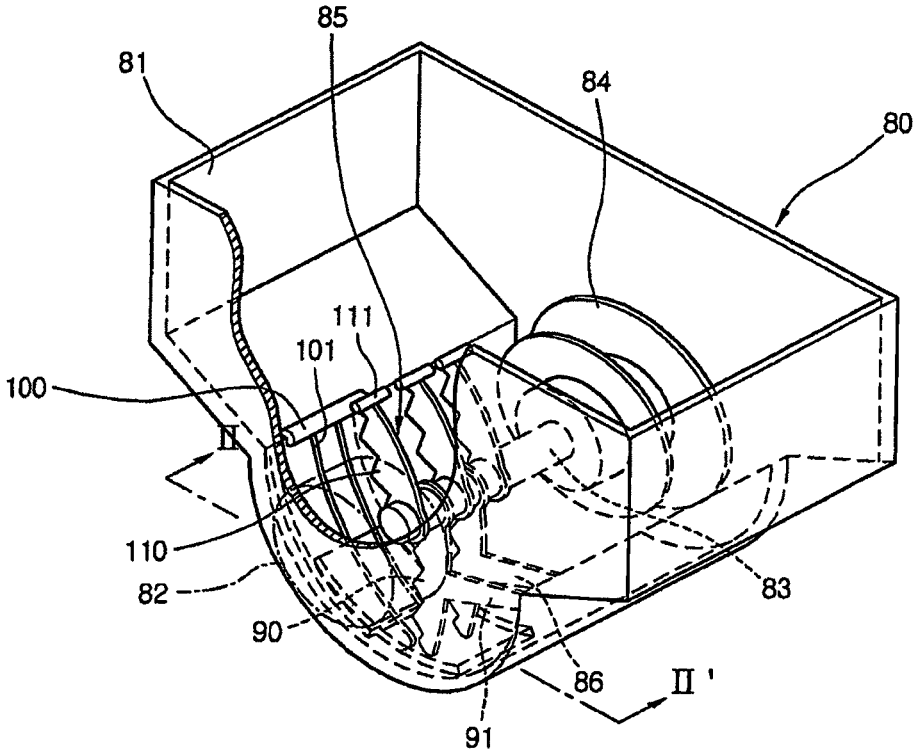
FIG. 8 is a perspective view of an ice bank according to a third embodiment of the present invention.
Figure 9:
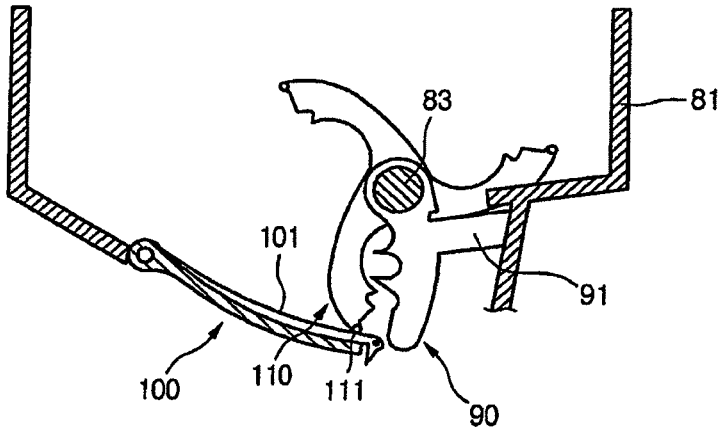
FIG. 9 is a vertical section taken along line II-II' of FIG. 8.

FIG. 8 is a perspective view of an ice bank according to a third embodiment of the present invention, and FIG. 9 is a vertical section taken along line II-II' of FIG. 8;

Referring to FIGS. 8 and 9, an ice bank 80 includes a casing 81, an ice crusher 85 disposed in a lower portion of the casing 81, and a carrier 84 carrying ice smoothly to the ice crusher 85. The ice bank 80 further includes an ice outlet 86 in a bottom surface and a shutter 100. Crushed ice falls through the ice outlet 86, and the size of the outlet 86 can be adjusted using the shutter 100 such that crushed ice having a desired size can fall through the ice outlet 86. Here, a spiral auger can be used for the carrier 84.

The ice crusher 85 includes stationary blades 90 fixed to the casing 81, rotary blades 110 rotating with respect to the stationary blades 90, a shaft 83 inserted into the rotary blades 110 for transmitting a driving force to the rotary blades 110, and a motor 82 connected to an end of the shaft 83.

In detail, the motor 82 is attached to an outer surface of the casing 81 and connected with the shaft 83 to transmit a driving power. One ends of the stationary blades 90 are fixed to a predetermined position on an inner surface of the casing 81, and the shaft 83 is supportedly inserted into a predetermined portion of the stationary blades 90. Therefore, the stationary blades 90 are not rotated when the shaft 83 rotates. For this, the shaft 83 and the stationary blades 90 may be not fixed to each other.

In operation of the ice crusher 85, ice is guided between the stationary blades 90 and the rotary blades 110 by rotation of the rotary blades 110 and is crushed by a force exerted by the rotation of the rotary blades 110. The crushed ice falls down through the ice outlet 86 formed under the stationary blades 90. A dispenser is disposed under the ice outlet 86 for supplying the fallen ice to a user.

The stationary blades 90 are directly connected to a predetermined portion of the casing 81.

In detail, although stationary blades are fixed using an additional bar in the related art, the stationary blades 90 are extended to the casing 81 and fixedly connected to the casing 81 according to the present invention. In this case, other component is not disposed between the stationary blades 90, such that ice can pass between the stationary blades 90 to the ice outlet 86. That is, when ice is discharged from a lower portion of the ice bank 80 to the outside, the ice is not disturbed by a component disposed between the stationary blades 90, such that the ice can move smoothly between the stationary blades 90.

The stationary blades 90 of the third embodiment will be more fully described with reference to FIG. 10.

Further, according to the third embodiment of the present invention, the shutter 100 includes guide protrusions 101 for guiding ice, and the rotary blades 110 includes ice removing protrusion 111 to remove ice attached to the casing 81 around the guide protrusion 101 when the ice bank 80 operates.

In detail, two or more guide protrusions 101 may be formed on an upper portion of the shutter 100. The guide protrusions 101 are spaced apart from each other by a predetermined distance. The guide protrusions 101 have a predetermined length in a rotation direction of the rotary blades 110. Preferably, the guide protrusions 101 are formed over the entire top surface of the shutter 100 in the rotation direction of the rotary blades 110. The guide protrusions 101 guide ice to the ice crusher 85, such that the ice can move smoothly to the rotary blades 110 and the stationary blades 90.

Further, one end of the shutter 100 is adjacent to the stationary blades 90 such that ice placed on the shutter 100 is not discharged to the outside but guided to the stationary blades 90 by the guide protrusions 101 until the ice is crushed to a desired size.

Meanwhile, if ice sticks to the top surface of the shutter 100, the ice removing protrusions 111 pushes the ice as the rotary blades 110 rotates. Therefore, the ice can be separated from the shutter 100 and discharged to the outside of the ice bank 80 through the ice outlet 86. That is, the ice removing protrusions 111 prevent the ice from sticking to the top surface of the shutter 100.

The stationary blades 90, the rotary blades 110, and the shutter 100 will now be more fully described with reference to FIGS. 10, 11, and 12 according to the third embodiment of the present invention.

Figure 10:
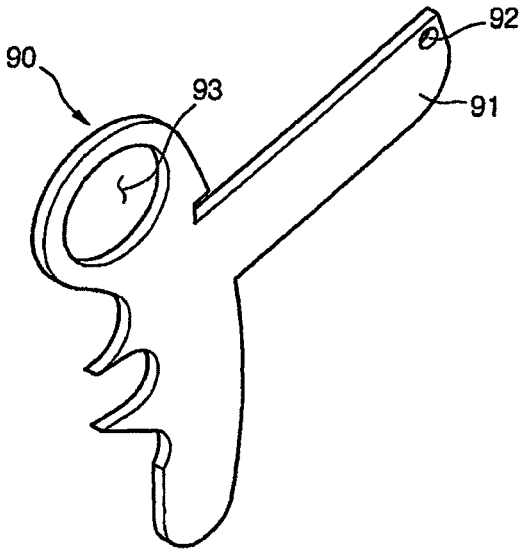
FIG. 10 is a perspective view of a stationary blade of the ice bank depicted in FIG. 8.

FIG. 10 is a perspective view of the stationary blade 90 of the ice bank 80 depicted in FIG. 8.

Referring to FIG. 10, the stationary blade 90 of the current embodiment includes an extension 91, a coupling hole 92, and an insertion hole 93. When assembled, the extension 91 is fixed to the casing 81, and the coupling hole 92 is used for fixing the extension 91 to a predetermined portion of the casing 81. The insertion hole 93 receives the shaft 83.

The extension 91 extends from a body of the stationary blade 90 and has a predetermined length. The extension 91 can be formed integrally with the stationary blade 90. In detail, the extension 91 extends from one side of the stationary blade 90, and the other side of the stationary blade 90 faces ice coming to the stationary blade 90. The coupling hole 92 is formed in an end of the extension 91. The coupling hole 92 couples to a predetermined portion of the casing 81 for fixing the extension 91 to the casing 81. Thus, the stationary blade 90 can be fixed to the casing 81. Owing to this structure, an additional member is not required to fix the stationary blade 90 to the ice bank 80, such that the space between the stationary blades 90 can be empty. Therefore, ice can smoothly pass through the space between the stationary blades 90, thereby preventing sticking of ice pieces around the stationary blades 90.

Figure 11:
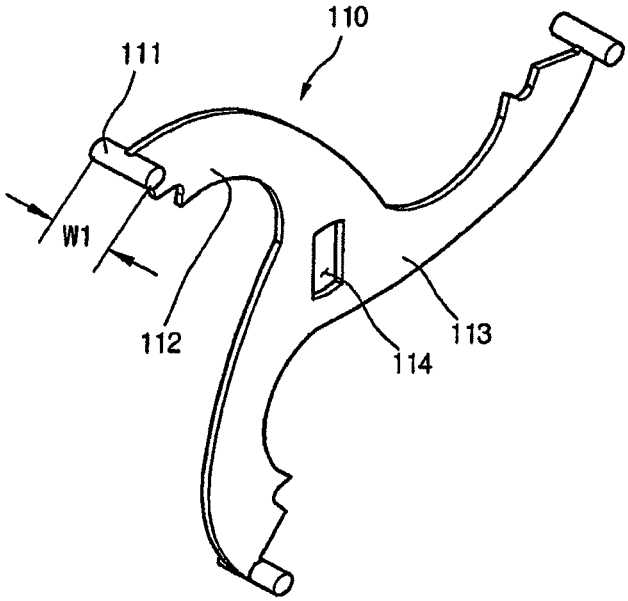
FIG. 11 is a perspective view of a rotary blade of the ice bank depicted in FIG. 8.

FIG. 11 is a perspective view of the rotary blade 110 of the ice bank 80 depicted in FIG. 8.

Referring to FIG. 11, the rotary blade 110 of the third embodiment includes a center portion 113 in which a shaft insertion hole 114 is formed, and extensions 112 extending from the center portion 113 by a predetermined length. Two or more extensions 112 may be formed and arranged at the same angle. Each extension 112 includes the ice removing protrusion 111 on an end. The ice removing protrusion 111 is used to separate ice from the top surface of the shutter 100.

In detail, the ice removing protrusion 111 extends from the end of the extension 112 toward both lateral sides by a predetermined length. Preferably, the ice removing protrusion 111 has a length W1 equal to or smaller than a gap W2 between the guide protrusions 101 of the shutter 100. In this case, the ice removing protrusion 111 can pass between the guide protrusions 101, such that ice stuck to the guide protrusions 101 can be effectively pushed by the ice removing protrusion 111. Therefore, sticking of the ice to the top surface of the shutter 100 can be effectively prevented by the ice removing protrusion 111.

Figure 12:
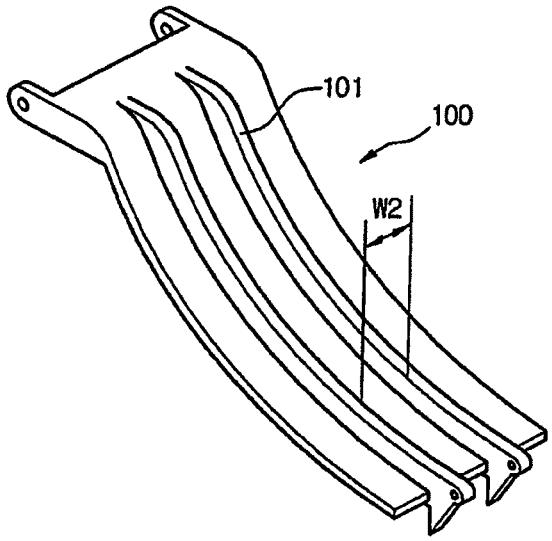
FIG. 12 is a perspective view of a shutter of the ice bank depicted in FIG. 8.

FIG. 12 is a perspective view of the shutter 100 of the ice bank 80 depicted in FIG. 8.

Referring to FIG. 12, the shutter 100 of the third embodiment includes the guide protrusions 101 formed on the top surface for guiding ice. Preferably, two or more guide protrusions 101 may be formed on the top surface of the shutter 100 for effectively guide the ice. The shutter 100 is used to discharge ice having a desired size. Further, sticking of the ice inside the ice bank 80 can be prevented by the shutter 100.

Particularly, one end of the shutter 100 is adjacent to the stationary blade 90. Therefore, ice placed on the shutter 100 can smoothly move to the stationary blade 90.

An operation of the ice bank 80 will now be described according to the third embodiment of the present invention.

An ice maker 5 disposed above the casing 81 makes ice, and the ice falls down to the ice bank 80. The ice is crushed in the ice bank 6 to a proper size and supplied to a user by a desired quantity.

For this, the carrier 84 is operated by a driving force transmitted from the motor 82 through the shaft 83. The ice is carried by the operation of the carrier 84 to the ice crusher 85. Then, the ice is crushed by the ice crusher 85 and discharged through the ice outlet 86. Here, the ice crusher 85 as well as the carrier 84 is used as an ice carrying part since the ice crusher 85 makes contact with the ice and pushes the ice. In detail, when the rotary blades 110 start rotating, the rotary blades 110 make direct contact with the ice to crush and move the ice.

Ice pieces can stick to each other around the ice outlet 86, thereby decreasing the operating reliability of the ice bank 80. In the current embodiment, the stationary blades 90 are directly fixed to the casing 81 without using an additional part, such that ice pieces can easily pass between the stationary blades 90. Therefore, an ice moving path can be clearly defined from the stationary blades 90 to the ice outlet 86, so that the ice pieces can be smoothly moved and discharged without sticking to each other. Further, since one end of the shutter 100 is adjacent to the stationary blades 90, ice moving on the shutter 100 can reach the stationary blades 90 without being discharged to the outside. Furthermore, since the ice removing protrusions 111 are formed on one ends of the rotary blades 110 to push ice on the top surface of the shutter 100, sticking of the ice to the top surface of the shutter 100 can be prevented. In this way, sticking of ice pieces can be prevented in the ice bank 80 according to the current embodiment of the present invention.

Meanwhile, the size of the ice outlet 86 can be adjusted using the shutter 100, such that ice having a desired size can be discharged through the ice outlet 86. In detail, when the shutter 100 is rotated to an open position, one end of the shutter 100 is spaced apart from the stationary blades 90. In this state, the ice outlet 86 between the shutter 100 and the stationary blades 90 is widely opened, such that relatively large ice can be discharged through the ice outlet 86.

When the shutter 100 is reversely rotated to a closed position, one end of the shutter 100 is adjacent to the stationary blades 90. In this state, the ice outlet 86 between the shutter 100 and the stationary blades 90 is narrow, such that relatively small ice crushed by the stationary blades 90 can be discharged through the ice outlet 86.

As described above, according to the ice bank of the present invention, the height of the ice receiving part of the ice accommodation chamber is smaller than the pressing height of the ice pressing unit, such that a pressing force can be smoothly applied to ice pieces placed on the ice receiving part from the ice pressing unit. Therefore, the ice pieces can be sequentially circulated in the ice accommodation chamber, thereby preventing the ice pieces from sticking to each other.

Further, the separator installed in the ice accommodation chamber can apply a pressing force to ice pieces placed on the ice receiving part. Therefore, pressing forces can be applied to the ice pieces from the separator and the ice pressing unit to circulate the ice pieces in the ice accommodation chamber, so that sticking of the ice pieces can be more reliably prevented in the ice accommodation chamber.

Further, since the stationary blades are directly fixed to the casing without using an additional supporting member such as a bar, an ice moving path can be defined without disturbance by the additional supporting member. Therefore, sticking of ice pieces can be prevented around the stationary blades 90.

Further, since the ice removing protrusions are formed on the end of the rotary blades to push ice pieces placed on the top surface of the shutter. Therefore, sticking of the ice pieces to the top surface of the shutter can be prevented.

In addition, since the end of the shutter is adjacent to the stationary blades, ice can be reliably guided from the top surface of the shutter to the stationary blades.

Therefore, according to the present invention, sticking of ice pieces can be prevented in the ice bank, thereby increasing the operating reliability of the ice bank.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A refrigerator, comprising:

a main body having a storage chamber;

a door for opening or closing the storage chamber;

an ice maker configured to make ice and mounted on the door;

an ice bank configured to receive the ice from the ice maker, and mounted to the door below the ice maker, the ice bank including an ice receiving part having an inclined surface and an outlet for discharging ice;

a carrier configured to move ice stored in the ice bank towards the outlet;

a shutter selectively opening or closing the outlet to adjust size of the ice to be discharged through the outlet;

a motor configured to rotate the carrier, the motor being located beneath the inclined surface of the ice bank; and an ice crusher for crushing the ice moved by the carrier, the ice crusher including:

a plurality of stationary blades fixed to the ice bank;

a plurality of rotary blades rotating with respect to the plurality of stationary blades, each stationary blade configured to be disposed between adjacent rotary blades; and a shaft crossing an inside of the ice bank, one end of each rotary blade coupled to the shaft to rotate integrally with the shaft, wherein each of the rotary blades includes:

a center portion in which the shaft is inserted;

a plurality of extensions radially extending from the center portion by a predetermined length and arranged at the same angle to each other in a circumferential direction of the center portion; and ice removing protrusions respectively formed at ends of the plurality of extensions to separate the ice stuck to a top surface of the shutter, wherein each of the ice removing protrusions extends in a predetermined length parallel to the shaft and has a shape of a cylindrical bar, and wherein the length of each of the ice removing protrusions is greater than a thickness of each of the plurality of extensions.

2. The refrigerator according to claim 1, wherein the shutter further comprises a plurality of guide protrusions protruding and extending along an upper surface thereof, and wherein the plurality of guide protrusions are spaced apart from each other by a predetermined distance.

3. The refrigerator according to claim 2, wherein the length of each of the plurality of ice removing protrusions is equal to or smaller than the gap between adjacent guide protrusions, such that each of the plurality of ice removing protrusions is placed in and moves along the gap when the rotary blades rotate.

4. The refrigerator according to claim 2, wherein the motor is located between the inclined surface and the door.

5. The refrigerator according to claim 1, wherein the ice crusher is located between the carrier and the motor.

6. The refrigerator according to claim 1, wherein the ice crusher is located right above the outlet.

7. The refrigerator according to claim 1, wherein the shaft extends horizontally in a direction substantially perpendicular to a rear surface of the door.

* * * * *